US008256138B2

(12) United States Patent
Koo et al.

(10) Patent No.: US 8,256,138 B2
(45) Date of Patent: Sep. 4, 2012

(54) AUTOMATIC DRYER AND METHOD FOR CONTROLLING THE SAME

(75) Inventors: Ja In Koo, Changwon-si (KR); Sun Cheol Bae, Masan-si (KR); Jin Seok Hu, Masan-si (KR); Yang Hwan Kim, Sasang-gu (KR)

(73) Assignee: LG Electronics Inc., Seoul (KR)

( * ) Notice: Subject to any disclaimer, the term of this patent is extended or adjusted under 35 U.S.C. 154(b) by 545 days.

(21) Appl. No.: 12/096,469

(22) PCT Filed: Jun. 14, 2006

(86) PCT No.: PCT/KR2006/002272
§ 371 (c)(1),
(2), (4) Date: Oct. 14, 2008

(87) PCT Pub. No.: WO2007/066863
PCT Pub. Date: Jun. 14, 2007

(65) Prior Publication Data

US 2009/0025250 A1 Jan. 29, 2009

(30) Foreign Application Priority Data

Dec. 6, 2005 (KR) ..... 10-2005-0118207

(51) Int. Cl.
*D06F 58/28* (2006.01)

(52) U.S. Cl. ..... 34/491; 34/524; 34/550; 34/574

(58) Field of Classification Search ..... 34/491, 34/524, 550, 565, 574
See application file for complete search history.

(56) References Cited

U.S. PATENT DOCUMENTS

| | | | | |
|---|---|---|---|---|
| 4,422,247 | A * | 12/1983 | Deschaaf | 34/550 |
| 4,733,479 | A * | 3/1988 | Kaji et al. | 34/446 |
| 4,738,034 | A * | 4/1988 | Muramatsu et al. | 34/524 |
| 2004/0066303 | A1 * | 4/2004 | Chernetski | 34/445 |
| 2005/0091876 | A1 | 5/2005 | Yang | |

FOREIGN PATENT DOCUMENTS

EP 1 600 549 A2 11/2005

* cited by examiner

*Primary Examiner* — Jiping Lu
(74) *Attorney, Agent, or Firm* — Birch, Stewart, Kolasch & Birch, LLP

(57) ABSTRACT

A method for controlling an automatic dryer is disclosed, which can determine a dryness level based on information relating the laundry by an initial average value of a sensing means, to thereby achieve stability and reliability in a drying process, the method comprising sensing whether the amount of laundry is small or large by using an average output value in a preset time period of an initial drying stage; detecting a saturation voltage generating point of the sensor; and performing a drying cycle based on each dryness level by using information for the amount of laundry and the saturation voltage generating point.

17 Claims, 6 Drawing Sheets

[Fig. 1]
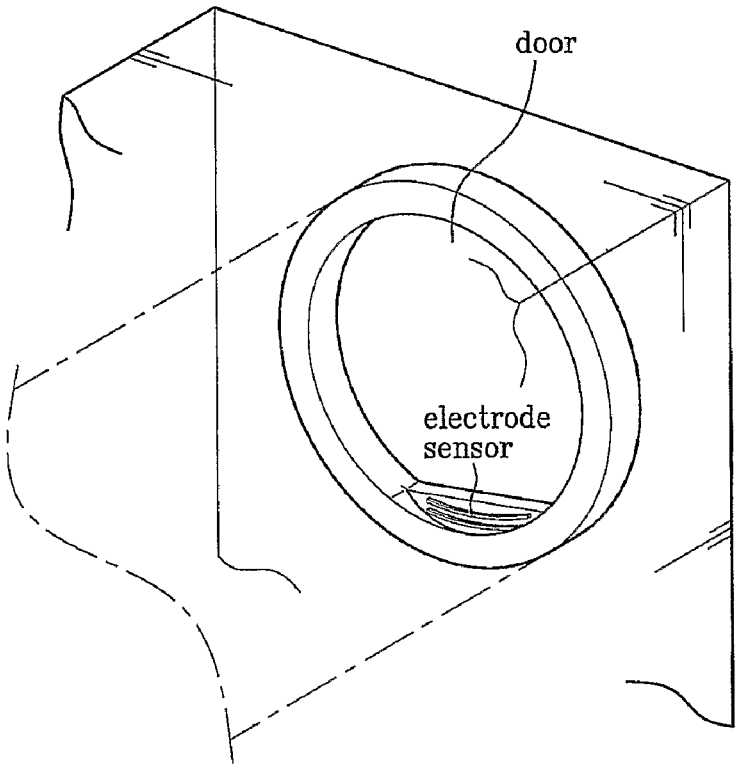
[Fig. 2]
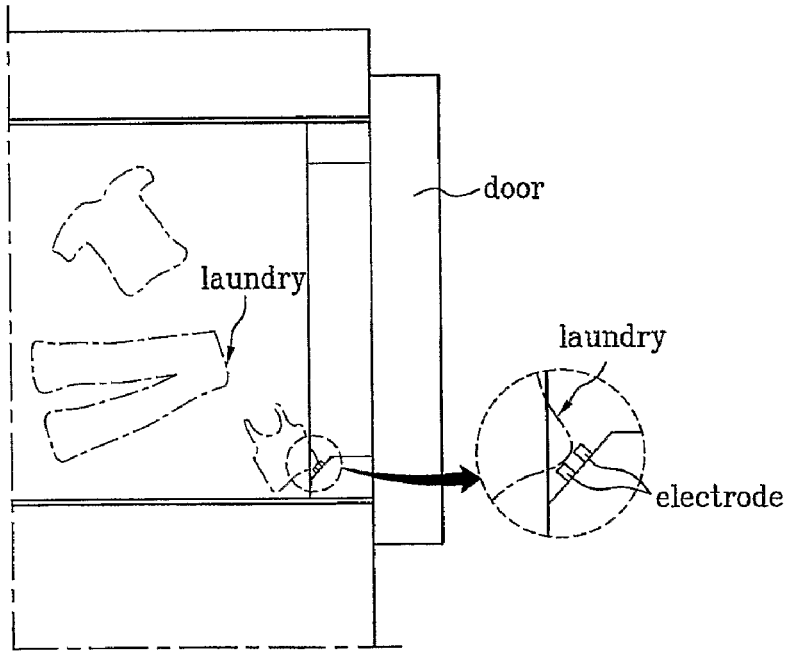

[Fig. 3]
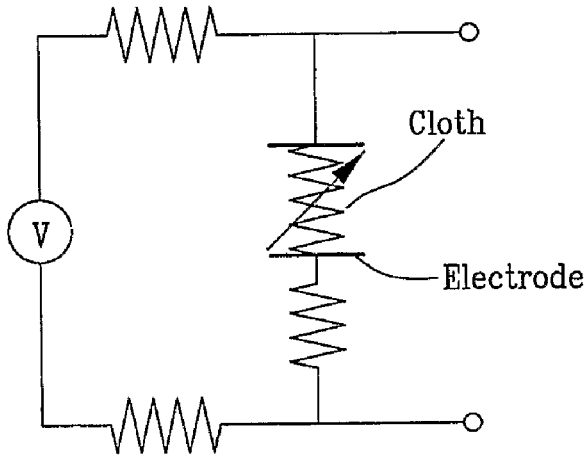
[Fig. 4]
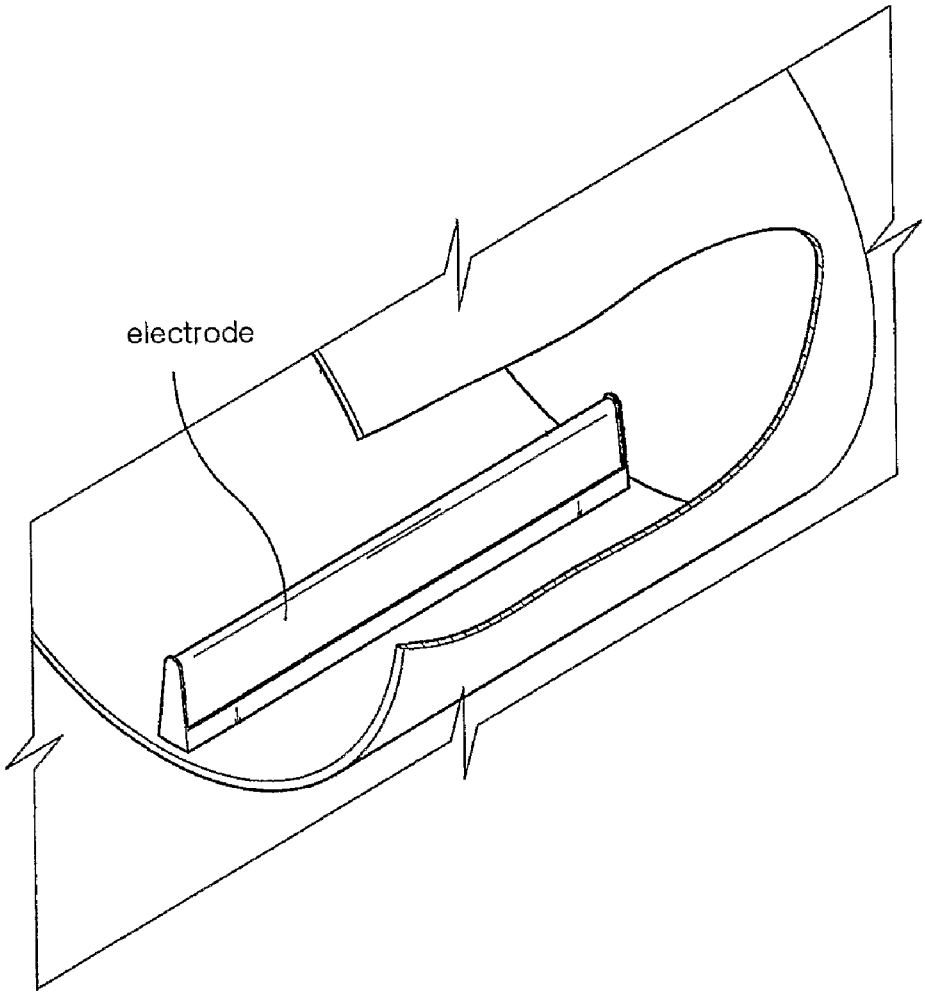

[Fig. 5]
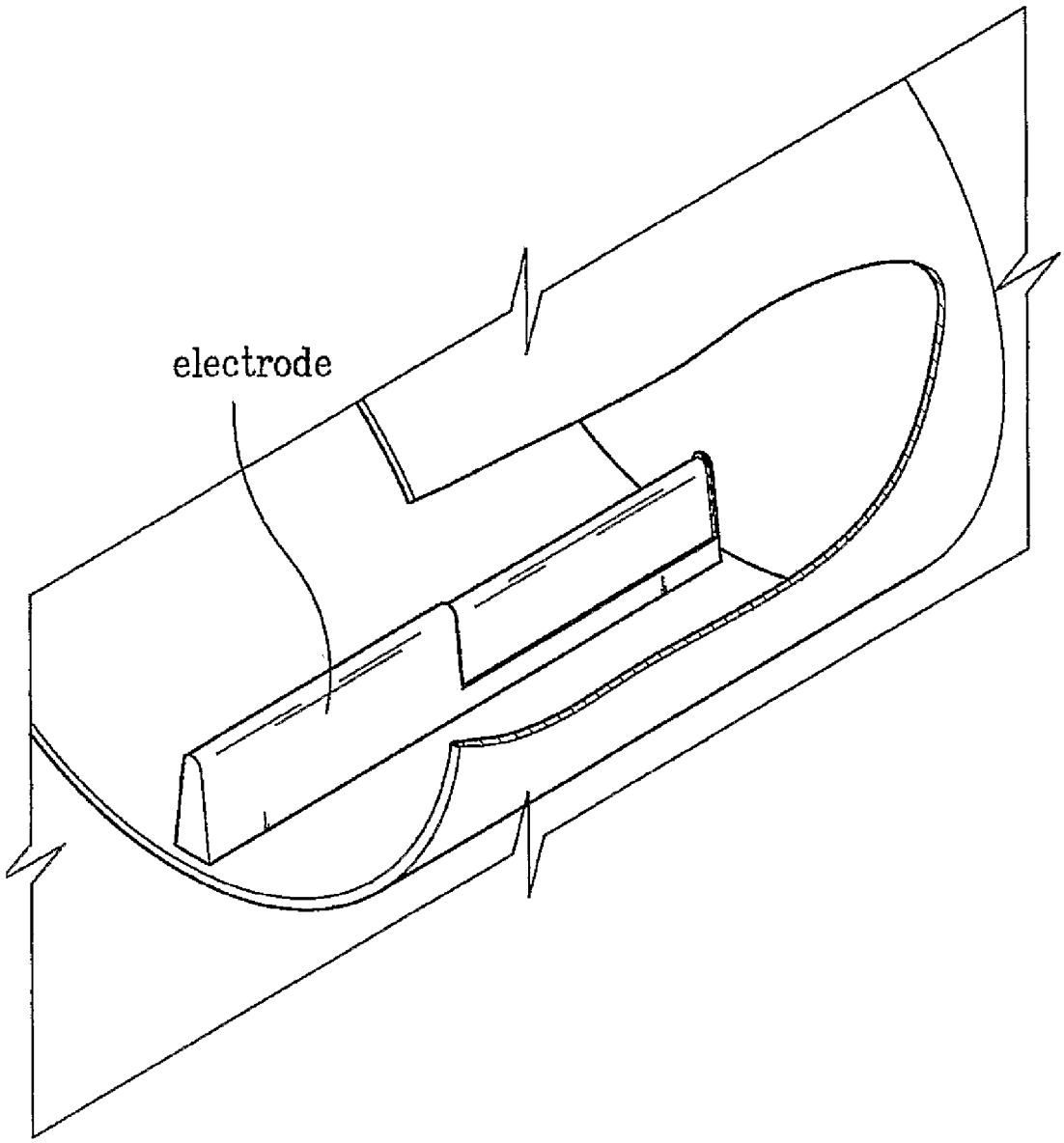

[Fig. 6]
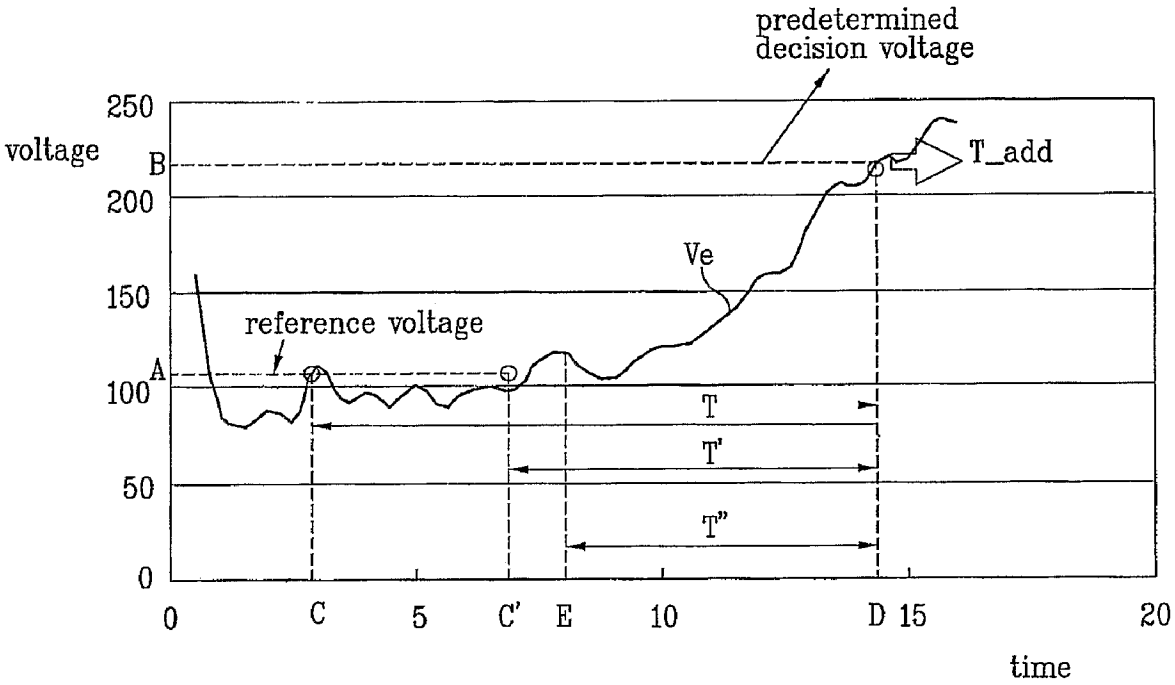
[Fig. 7]
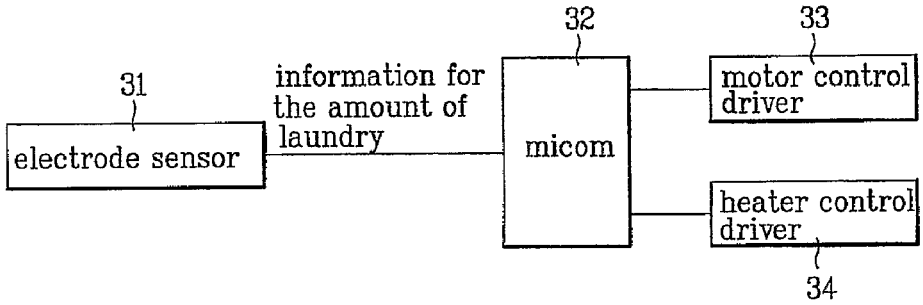

[Fig. 8]
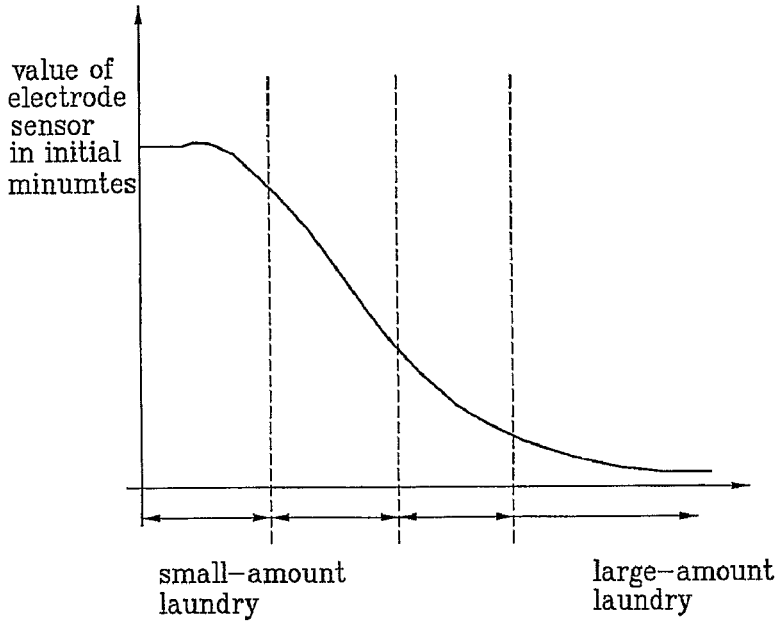
[Fig. 9]
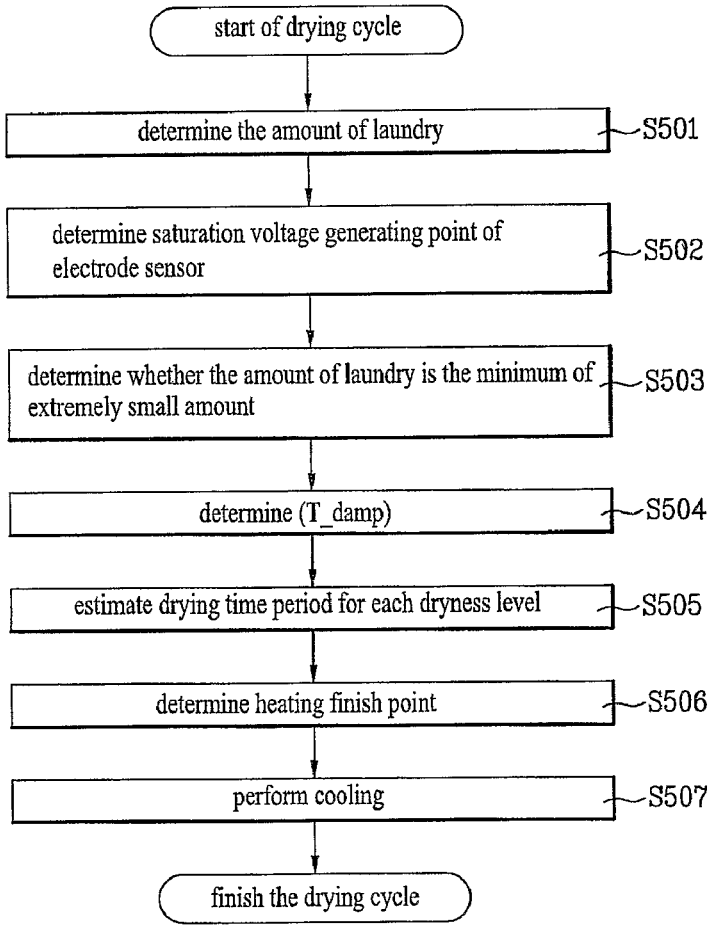

[Fig. 10]
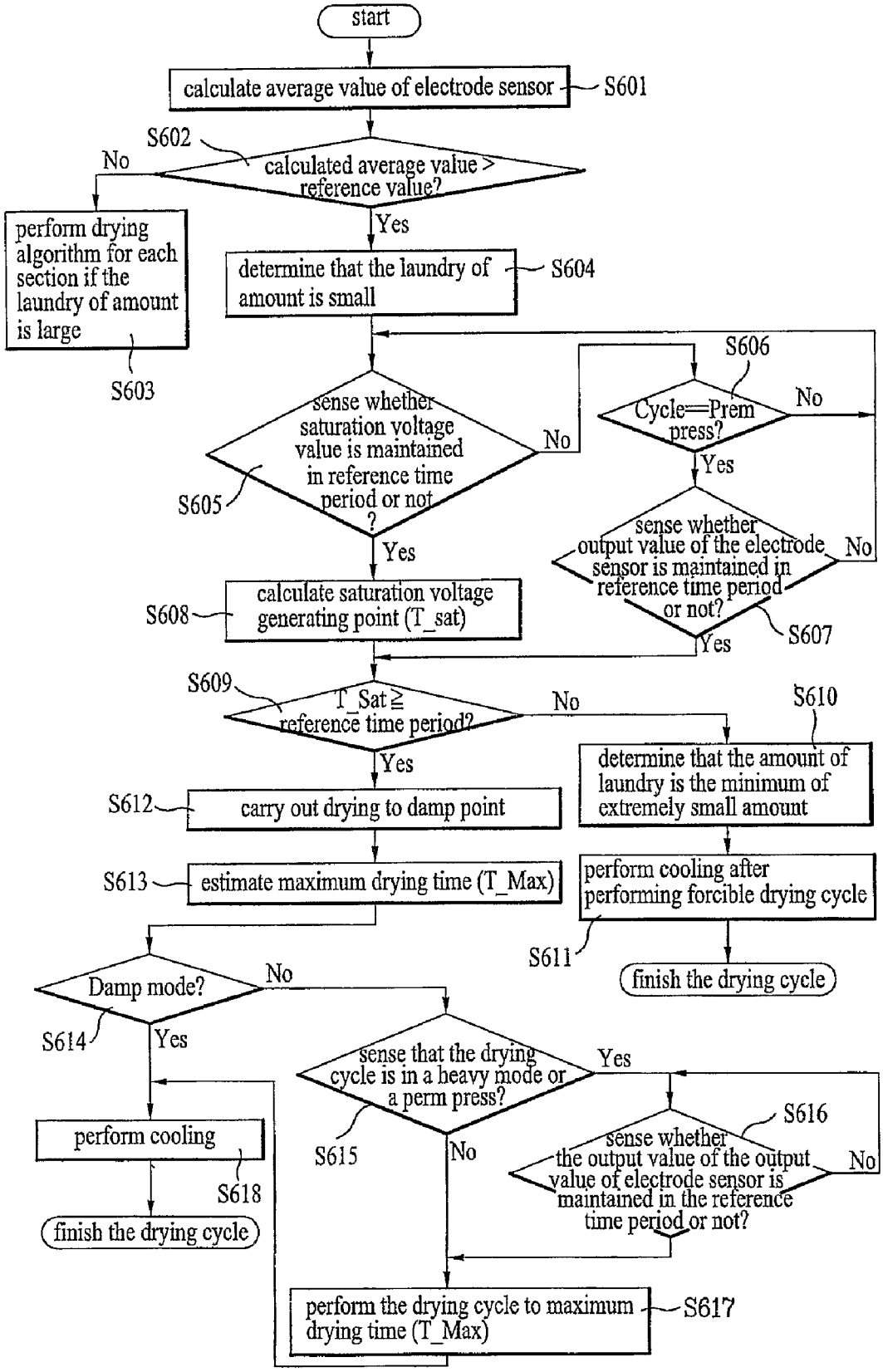

AUTOMATIC DRYER AND METHOD FOR CONTROLLING THE SAME

TECHNICAL FIELD

The present invention relates to an automatic dryer, and more particularly, to a method for controlling an automatic dryer which can determine a dryness level based on information relating the laundry by an initial average value of a sensing means, to thereby achieve stability and reliability in a drying process.

BACKGROUND ART

Generally, an automatic dryer is an apparatus to automatically dry the wet laundry cleaned, which is largely classified into a condensing type which circulates the inside air; and an exhausting type which introduces the outside air to the inside.

The automatic dryer of the exhausting type heats the introduced outside air by a heater, and supplies the heated air to the inside of a drum which is in a rotating state, to thereby dry the laundry such as clothes received in the inside of the drum.

FIGS. 1 to 5 illustrate an exemplary electrode sensor provided in a drying drum, and FIG. 3 illustrates a circuit diagram of the electrode sensor.

In the automatic dryer that determines a dryness level with the electrode sensor, two electrodes are separately provided at predetermined portions of the drying drum having the laundry therein, for example, at a lifter or a lower side of a door, for being in contact with the laundry. In this case, as the laundry contacts with the electrodes, a resistance value is changed according to a water content of the laundry.

Accordingly, a voltage value depends on the changeable resistance value. Then, a micom reads the voltage value to thereby determine the dryness level.

That is, if the water content of the laundry is decreased with the progress of drying stroke, the resistance value is increased, and the voltage value is increased in proportion to the resistance value. When the voltage value is constant, the micom regards it as being a drying finish point.

FIG. 4 illustrates the electrode sensor which is formed in an entire length of the lifter. FIG. 5 illustrates an electrode sensor which is formed in a partial portion of the lifter.

When determining the drying finish point based on the dryness level obtained indirectly by the above electrode sensor, it is difficult to obtain the exactness in determination of the drying finish point since the dryness level is obtained based on the resistance value changed by the contact state with the laundry.

Especially, if trying to dry the small amount of laundry by the above electrode sensor, there is a difficulty in ascertaining the exact amount of the laundry. Thus, the laundry may be partially un-dried or over-dried, whereby a power may be consumed excessively.

When drying the large amount of laundry, the discrimination for the dryness level becomes low due to the saturation output value of the electrode sensor.

Furthermore, it is difficult to realize the exact determination for the dryness level since the identical method is applied to the laundry without consideration of the amount of laundry.

DISCLOSURE OF INVENTION

Technical Problem

An object of the present invention is to provide a method for controlling an automatic dryer which can determine a dryness level based on information relating the laundry by an initial average value of a sensing means, to thereby achieve stability and reliability in a drying process.

Technical Solution

To achieve these objects and other advantages and in accordance with the purpose of the invention, as embodied and broadly described herein, a method of controlling an automatic dryer, which uses a sensor output value detected by a contact with the laundry, comprises determining whether the amount of laundry is small or large by using an average output value in a preset time period of an initial drying stage; detecting a saturation voltage generating point of the sensor; and performing a drying cycle based on each dryness level by using information for the amount of laundry and the saturation voltage generating point.

At this time, if it is sensed that the amount of laundry is large by using the average output value in the preset time period of the initial drying stage, an occurrence of a reference voltage is estimated at a corresponding point when the output value of the sensor is outputted above a reference voltage value and is maintained for a reference time period, and an additional drying time (T_add) is calculated in proportion to the time period required from the corresponding point to a point of detecting a dryness level decision voltage.

If it is sensed that the amount of laundry is small by using the average output value in the preset time period of the initial drying stage, it is required to detect a saturation voltage generating point.

If a saturation voltage value is outputted at a corresponding point, and is maintained in a reference time period, the corresponding point is determined as the saturation voltage generating point.

If the saturation voltage generating point occurs in the reference time period which is differently set in each dryness level, it is determined that the laundry amount is the minimum of extremely small amount that causes the laundry to be sticking to an inner surface of a drum, whereby a forcible drying cycle for the laundry is carried cut, and then is finished.

In addition, the method includes sensing whether a user selects another drying cycle having the differently set saturation voltage value and reference time period or not, when sensing whether the saturation voltage value is outputted at the corresponding point, and is maintained in the reference time period.

At this time, a maximum drying time (T_max) is calculated in a corresponding point of a damp mode if the saturation voltage generating point occurs after the lapse of the reference time period, and the drying cycle is carried out to the corresponding point of the damp mode if the user selects the damp mode.

If the damp mode is not selected by the user, the following drying is carried out with reference to the calculated maximum drying time (T_max).

Also, if the damp mode is not selected by the user, the drying cycle is carried out during a time period selected by the user, and it is sensed to reach the maximum drying time (T_max).

Advantageous Effects

Accordingly, the method for controlling the automatic dryer according to the present invention has the following advantages.

Even though the amount of laundry is in various levels, it is possible to determine the exact dryness level based on the corresponding amount of the laundry by using the electrode sensor.

After the information relating the amount of laundry is obtained by the initial average output value of the electrode sensor, the drying cycle is carried cut with the different dryness level decision values (variables based on the amount of laundry) for the respective sections divided by the amount of laundry, to thereby determine the exact dryness level according to the corresponding amount of the laundry.

If the amount of laundry is small, the maximum drying time for each dryness level is estimated with the saturation voltage generating point, to thereby prevent the laundry from being over-dried.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIGS. 1 and 2 are perspective views of illustrating an exemplary electrode sensor provided in an automatic dryer, and FIG. 3 is a circuit diagram of illustrating the electrode sensor.

FIGS. 4 and 5 are partially cut perspective views of illustrating other types of the electrode sensor.

FIG. 6 is a graph of illustrating a dryness level by an electrode sensor of an automatic dryer.

FIG. 7 is a block diagram of illustrating an automatic dryer according to the present invention.

FIG. 8 is a graph of illustrating sections of the amount of laundry based on an initial output of an electrode sensor in an automatic dryer according to the present invention.

FIG. 9 is a flowchart of illustrating a method for controlling an automatic dryer according to the present invention.

FIG. 10 is a detailed flowchart of illustrating a method for controlling an automatic dryer according to the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 6 is a graph of illustrating a dryness level by an electrode sensor of an automatic dryer. FIG. 7 is a block diagram of illustrating an automatic dryer according to the present invention. FIG. 8 is a graph of illustrating sections of the amount of laundry based on an initial output of an electrode sensor in an automatic dryer according to the present invention.

In the automatic dryer and the control algorithm according to the present invention, the amount of supplied laundry is divided into sections by using an initial average value of an electrode sensor that has an output voltage changed based on a moisture content of the laundry, to thereby determine an exact dryness level for the laundry based on the corresponding amount of the laundry.

The information for the amount of laundry is collected using the initial average value of the electrode sensor, to thereby perform a small-amount algorithm and a large-amount algorithm.

If performing the small-amount algorithm, a maximum drying time period (duration) is estimated using a saturation voltage generating point of the electrode sensor, to thereby prevent the laundry from being over-dried in each dryness level.

In case of the large-amount algorithm, it uses a time period required from a reference value generating point to a predetermined decision voltage value outputting point. In this case, an additional drying time period is determined based on a variable changed by the corresponding amount of laundry.

In more detail, as shown in FIG. 6, a drying process is performed such that the additional drying time period (T_add) is allotted in proportion to the time period (T) from the point (C) of generating the reference voltage value (A) to the point (D) of outputting the predetermined voltage value (B) after starting the drying process.

In FIG. 6, 'Ve' shows the change of voltage value outputted from the electrode sensor. The output value of the electrode sensor is changed based on the progress of the drying process. In this case, the change of the output voltage is not in a constant pattern due to noise. Accordingly, as shown in FIG. 6, if the point of generating the reference voltage value (A) corresponds to not (C) but (C'), the additional drying time period (T_add) is determined based on not (T) but (T'), thereby causing a problem of untried or over-dried laundry.

In the present invention, the point of generating the reference voltage value is determined in the following method.

To decrease noise effect and to achieve the exact dryness level, the average output value of the electrode sensor is evaluated in the preset period. If the average output value is maintained in a reference time period, it is referred to as the point of generating the reference voltage.

For example, if providing the large amount of laundry, as shown in the graph of FIG. 6, the average output value of the electrode sensor is evaluated in the preset period. In this case, if the average output value is maintained in the preset time period to the point (E), the additional drying time period (T_add) is determined with reference to the time period (T") to the point (D) of outputting the predetermined voltage value (B).

The change of the initial output value of the electrode sensor depends on the amount of laundry. Thus, the dryness level is determined based on the information relating the amount of laundry, whereby it is possible to realize more exact determination for the dryness level of the supplied laundry.

The automatic dryer which realizes the above control algorithm according to the present invention has a structure of FIG. 7.

The automatic dryer includes the electrode sensor 31 which has the output value changed based on the progress of drying process; the micom 32 which divides the amount of laundry into sections by using the initial average value of the electrode sensor that has the output voltage changed based on the moisture content of the laundry, and detects the point of generating the saturation voltage value of the electrode sensor, to control the dryness level of the supplied laundry based on the corresponding section for the amount of laundry; a motor control driver which controls the driving of a motor under control of the micom 32; and a heater control driver which controls the driving of a heater under control of the micom 32.

When the wet laundry containing the moisture is in contact with both metal electrode plates at the same time, a circuit is in an electric connection state. Thus, the laundry functions as a resistance inside the circuit, whereby the micom reads the corresponding output voltage value.

If the moisture content of the laundry is decreased with the progress of drying process, a resistance value is increased in inverse proportion to the moisture content of the laundry, and the voltage value is increased in proportion to the resistance value.

FIGS. 1 to 5 illustrate the exemplary structures of the electrode sensor. The electrode sensor of the present invention may be formed in other structures. Also, the automatic dryer may be formed in other structures and positions.

FIG. 8 illustrates a graph of showing a saturation section according to the initial output value of the electrode sensor of the automatic dryer according to the present invention. As shown in FIG. 8, there are four sections divided by the amount of laundry. However, it is possible to provide more sections than four.

The control algorithm of the automatic dryer according to the present invention will be explained with reference to FIG. 9.

FIG. 9 is a flowchart of illustrating a method for controlling the automatic dryer according to the present invention.

If providing the large amount of laundry, it has the exactness in determination of the dryness level for the laundry owing to the characteristics of the electrode sensor. In this case, the sections for the amount of laundry are divided according to the level of the initial average value, wherein the respective sections have the different variables, to thereby determine the dryness level for the laundry. If providing the small amount of laundry, the dryness level for the laundry is determined using a point (T_sat) of generating the saturation voltage value, to thereby improve the exactness.

As shown in FIG. 9, with the start of the drying process, the information for the amount of supplied laundry is collected according to the level of the average value of the electrode sensor in the reference time period of the initial drying stage (S501).

After that, it is sensed whether the saturation voltage value is outputted from the electrode sensor or not. Then, the point (T_sat) of generating the saturation voltage value is calculated (S502).

The drying time period for each of the dryness levels (to which the information for the amount of supplied laundry is applied) is estimated based on the point (T_sat) of generating the saturation voltage value.

Subsequently, the calculated point (T_sat) of generating the saturation voltage value is compared with the reference time, so as to determine whether the amount of laundry is the minimum or not. If the amount of laundry is the minimum of the extremely small amount, the laundry may be sticking to an inner surface of a drum (S503).

That is, if the saturation voltage generating point (T_sat) occurs in the preset time period, it is determined that the amount of laundry is the minim of extremely small amount, and the drying process is performed.

Then, it is required to detect a damp point (T_Damp) having the conditions (the laundry has any degree of the moisture) of a damp mode suitable for ironing of the laundry (S504).

Subsequently, a maximum drying time period (T_max) is estimated from the damp point (T_Damp) according to the dryness level and the drying cycle selected by the user (S505).

After a heating finish point is determined based on the above result of the reference value comprising detection (S506), a cooling cycle is performed (S507), and then the drying cycle is finished.

To exactly determine the dryness level, it necessarily requires the average value output level of the electrode sensor in the initial drying stage, the saturation voltage generating point (T_sat), and the maximum drying time period (T_max) from the damp point.

Hereinafter, a detailed control method for determining the dryness level of an automatic dryer according to the present invention will be described with reference to FIG. 10.

FIG. 10 is a detailed flowchart of illustrating a method for controlling an automatic dryer according to the present invention.

To divide the amount of laundry into sections, firstly, an average value (M) of the electrode sensor is calculated in a preset time period from a preset reference value point (ref_t1) (S601). For example, the average value (M) of the electrode sensor is calculated for 1 minute from 1-minute point after starting the drying cycle to 2-minute point.

Then, the calculated average value (M) is compared with the reference value (ref_1). If the average value (M) is larger than the reference value (ref_1), it is referred to as the small amount of the laundry (S604).

As shown in FIG. 8, the amount of laundry is divided into the sections, wherein each section has the corresponding reference value. That is, the dryness level is determined based on the corresponding section which is selected by the amount of laundry.

If the amount of laundry is large, the large-amount algorithm is performed. In this case, when the average value of the electrode sensor in the preset time period is calculated, and the calculated average value is maintained to the point (E), the additional drying time period (T_add) is determined based on the time period (T") to the point (D) of generating the predetermined voltage value (B).

As progressing the drying cycle, a saturation voltage value (N) is outputted. Then, it is sensed whether the corresponding saturation voltage value (N) is maintained during a reference time period (ref_t2) (S605).

In this case, each of the drying courses has the different reference time period (ref_2). For example, if the saturation voltage value (N) is maintained in the time period of 'P' it is determined that the saturation voltage value (N) is maintained in the reference time period (ref_2), thereby calculating a saturation voltage value generating point (T_sat) (S608). At this time, the value of 'P' is differently provided to each of the drying courses.

During performing the above cycle, it is sensed whether the proceeding cycle corresponds to a perm press cycle used for shirts of the small amount (S606). If the user selects the perm press cycle, the saturation voltage value generating point (T_sat) is calculated with reference to another saturation voltage value and the reference time (for example, ADC decimal data 180, P-value for 3 minutes) (S607).

Subsequently, the calculated saturation voltage value generating point (T_sat) is compared with a reference time period (ref_t3) (S609). If the saturation voltage occurs in the preset time period, it is determined that the laundry is in the minimum state of the extremely small amount, whereby the laundry may be sticking to the inner surface of the drum (S610). Accordingly, the drying cycle is forcibly performed, and then cooling cycle is performed (S611).

In case of that the amount of laundry is in the minimum state, the laundry is not sticking to the inner surface of the drum in the initial stage of the drying cycle since the laundry contains the sufficient moisture. However, as proceeding the drying cycle, the laundry may be sticking to the inner surface of the drum or lifter since the moisture content of the laundry is decreased, whereby the saturation voltage is outputted in the reference time period (ref_t3). In this case, the drying process for the preset time period is forcibly performed since it is difficult to proceed with the normal drying algorithm.

If the saturation voltage value generating point (T_sat) is outputted after the reference time period (ref_3), it is determined that the amount of laundry is not in the minimum but in the small.

On starting the drying cycle, firstly, the laundry is dried to a damp point suitable for the damp mode of the laundry (S612). In each dryness level, it is necessary to calculate the time period from the damp point to the maximum drying time point (T_max).

After calculating the maximum drying time period (T_max) from the damp point in each dryness level, it is required to sense whether the progressing drying mode is a damp mode or not (S614). If the progressing drying mode is the damp mode, the cooling cycle is performed, and the drying cycle is finished (S618).

If the drying course corresponds to the perm press cycle for the shirts, or a heavy cycle for jeans, the output value of the electrode sensor above the reference value (ref_2) is maintained during a reference time period (ref_t4) (S616). Then, the drying cycle is performed in the estimated maximum drying time period (T_max) (S617), and the cooling cycle is performed, and the drying cycle is finished (S618).

In the above control method of the automatic dryer according to the present invention, the amount of laundry is measured, and the laundry is treated in the corresponding section divided by the measured amount. That is, the dryness level for the laundry is determined based on the corresponding section selected by the measured amount of laundry. If providing the large amount of laundry, the drying cycle is performed by using the value for the dryness level based on the section corresponding to the measured amount of the laundry. In case of the small amount of laundry, the drying cycle is performed by using the saturation voltage value generating point (T_sat), to realize the drying process for the minimum amount of the laundry, the damp mode, the perm press, or the heavy cycle.

Also, the drying control is performed using the maximum drying time (T_max) obtained at the damp point.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

As mentioned above, the method for controlling the automatic dryer according to the present invention has the following advantages.

The method for controlling the automatic dryer according to the present invention can determine the dryness level based on information relating the laundry by the initial average value of the sensing means, to thereby achieve stability and reliability in the drying process. By decreasing the noise effect on determination of the dryness level, it is possible to prevent the laundry from being un-dried or over-dried.

The invention claimed is:

1. A method of controlling an automatic dryer, which uses a sensor output value affected by contact with laundry, comprising:

determining whether the amount of laundry is small or large by using an average output value of the sensor in a preset time period of an initial drying stage;

detecting a saturation voltage generating point of the sensor; and performing a drying cycle based on each dryness level by using information for the amount of laundry and the saturation voltage generating point, wherein the amount of laundry is determined to be large when the average output value in the preset time period of the initial drying stage is lower than a preset output value, and the amount of laundry is determined to be small when the average output value in the preset time period of the initial drying stage is higher than the preset output value, wherein, when the amount of laundry is sensed to be small by using the average output value in the preset time period of the initial drying stage, detection of a saturation voltage generating point is required, and wherein, when the amount of laundry is sensed to be large by using the average output value in the preset time period of the initial drying stage, an occurrence of a reference voltage is estimated at a corresponding point when the output value of the sensor is outputted above a reference voltage value and is maintained for a reference time period, and an additional drying time (T_add) is calculated in proportion to the time period required from the corresponding point to a point of detecting a dryness level decision voltage.

2. The method of claim 1, wherein, when a saturation voltage value is outputted at a corresponding point, and is maintained in a reference time period, the corresponding point is determined as the saturation voltage generating point.

3. The method of claim 2, further comprising:

sensing whether a user selects another drying cycle having the differently set saturation voltage value and reference time period or not, when sensing whether the saturation voltage value is outputted at the corresponding point, and is maintained in the reference time period.

4. The method of claim 2, wherein a maximum drying time (T_max) is calculated in a corresponding point of a damp mode when the saturation voltage generating point occurs after the lapse of the reference time period, and the drying cycle is carried out to the corresponding point of the damp mode when the user selects the damp mode.

5. The method of claim 4, wherein, when the damp mode is not selected by the user, the following drying is carried out with reference to the calculated maximum drying time (T_max).

6. The method of claim 4, wherein, when the damp mode is not selected by the user, the drying cycle is carried out during a time period selected by the user, and it is sensed to reach the maximum drying time (T_max).

7. The method of claim 1, wherein, when the saturation voltage generating point occurs in the reference time period which is differently set in each dryness level, it is determined that the laundry amount is the minimum of extremely small amount that causes the laundry to be sticking to an inner surface of a drum, whereby a forcible drying cycle for the laundry is carried out, and then is finished.

8. The method of claim 1, wherein the sensor is an electrode sensor.

9. An automatic dryer comprising:

a sensor which has an output value affected by contact with the laundry and changed with progress of a drying cycle; and a micom configured to determine the amount of laundry and dryness level according to the output value from the sensor, and control the drying cycle, wherein the micom is further configured to determine the laundry amount according to an average output value of the sensor in a preset time period of an initial drying stage and the amount of laundry is determined to be large when the average output value in the preset time period of the initial drying stage is lower than a preset output value, and the amount of laundry is determined to be small when the average output value in the preset time period of the initial drying stage is higher than the preset output value, wherein the micom is further configured to detect a saturation voltage generating point of the sensor when the micom determines that the laundry amount is small.

10. The automatic dryer of claim 9, further comprising:

a motor control driver which controls a driving of a motor for the progress of the drying cycle under control of the micom; and a heater control driver which controls a driving of a heater for the progress of the drying cycle under control of the micom.

11. The automatic dryer of claim 9, wherein the sensor is an electrode sensor.

12. The automatic dryer of claim 9, wherein the micom is further configured to estimate an occurrence of a reference voltage at a corresponding point when the output value of the sensor is outputted above a reference voltage value and is maintained for a reference time period, and wherein the micom is further configured to determine a dryness level by a time period required from the corresponding point of outputting the reference voltage to a point of detecting a predetermined decision voltage.

13. The automatic dryer of claim 12, wherein the micom is further configured to allot an additional drying time period being in proportion to the time required.

14. The automatic dryer of claim 12, wherein the micom is further configured to determine the dryness level of the laundry based on the time required when the laundry amount is large.

15. The automatic dryer of claim 9, wherein, when the saturation voltage generating point occurs in the reference time period which is differently set in each dryness level, the micom is further configured to determine that the laundry amount is the minimum of extremely small amount that causes the laundry to be sticking to an inner surface of a drum, whereby a forcible drying cycle for the laundry is carried out, and then is finished.

16. The automatic dryer of claim 9, wherein the micom is further configured to calculate a maximum drying time (T_max) in a corresponding point of a damp mode when the saturation voltage generating point occurs after the lapse of the reference time period, and the micom is further configured to carry out the drying cycle to the corresponding point of the damp mode when user selects the damp mode.

17. The automatic dryer of claim 16, wherein, when the damp mode is not selected by the user, the micom is further configured to carry out the drying cycle during a time period selected by the user, and the maximum drying time (T_max) is reached.

* * * * *